US005091106A

United States Patent [19]

Jacobs et al.

[11] Patent Number: 5,091,106

[45] Date of Patent: Feb. 25, 1992

[54] GRANULAR BLEACH AGENT: SOLID ALIPHATIC PEROXY-CARBOXYLIC ACID, INORGANIC SALT HYDRATE AND ORGANIC POLYMER

[75] Inventors: Jochen Jacobs, Wuppertal; Edgar Koeppelmann, Hilden; Martin Witthaus, Duesseldorf; Manfred Dankowski, Karlstein, all of Fed. Rep. of Germany

[73] Assignee: Henkel Kommanditgesellschaft auf Aktien, Duesseldorf-Holthausen, Fed. Rep. of Germany

[21] Appl. No.: 858,422

[22] Filed: May 1, 1986

[30] Foreign Application Priority Data

May 2, 1985 [DE] Fed. Rep. of Germany ..... 3515712

[51] Int. Cl.[5] ..... C11D 3/39; C11D 7/60; C11D 17/06; D06L 3/02

[52] U.S. Cl. ..... 252/186.26; 8/107; 8/111; 252/100; 252/174.23; 252/174.24; 252/133; 252/186.25; 252/186.37; 252/186.38; 252/DIG. 12; 264/117

[58] Field of Search ..... 252/100, 174.23, 174.24, 252/133, 186.1, 186.25, 186.26, 186.37, 186.38; 264/117; 8/107, 111

[56] References Cited

U.S. PATENT DOCUMENTS

| | | | |
|---|---|---|---|
| 3,227,790 | 1/1966 | Bretschneider et al. | 264/117 |
| 3,639,285 | 2/1972 | Nielsen | 252/100 |
| 3,664,961 | 5/1972 | Norris | 252/99 |
| 3,770,816 | 11/1973 | Nielsen | 260/502 R |
| 3,975,280 | 8/1976 | Hachmann et al. | 252/102 |
| 3,997,459 | 12/1976 | Bogie et al. | 252/99 |
| 4,013,581 | 3/1977 | Huber | 252/186 |
| 4,086,413 | 4/1978 | Stedefer et al. | 525/383 |
| 4,126,573 | 11/1978 | Johnston | 252/99 |
| 4,128,495 | 12/1978 | McCrudden | 252/186 |
| 4,170,453 | 10/1979 | Kitko | 8/111 |
| 4,225,451 | 9/1980 | McCrudden | 252/99 |
| 4,259,201 | 3/1981 | Cockrell, Jr. et al. | 252/103 |
| 4,287,135 | 9/1981 | Stober et al. | 260/502 R |
| 4,288,388 | 9/1981 | McCrudden et al. | 260/502 R |
| 4,403,994 | 9/1983 | Hignett | 252/94 |
| 4,497,757 | 2/1985 | Beimesch et al. | 264/13 |
| 4,559,159 | 12/1985 | Denzinger et al. | 252/174.24 |
| 4,567,010 | 1/1986 | Hutton et al. | 252/174.24 |

FOREIGN PATENT DOCUMENTS

| | | | |
|---|---|---|---|
| 651777 | 11/1962 | Canada . | |
| 1190441 | 7/1985 | Canada . | |
| 145438 | 6/1985 | European Pat. Off. | 252/186.25 |
| 0212976 | 4/1987 | European Pat. Off. . | |
| 1387167 | 3/1975 | United Kingdom . | |
| 1456591 | 11/1976 | United Kingdom . | |
| 1456592 | 11/1976 | United Kingdom . | |
| 1476682 | 6/1977 | United Kingdom . | |

*Primary Examiner*—A. Lionel Clingman
*Attorney, Agent, or Firm*—Ernest G. Szoke; Henry E. Millson, Jr.; Wayne C. Jaeschke

[57] ABSTRACT

Bleaching agents in the form of granulates of uniform composition which contain (a) a solid aliphatic peroxycarboxylic acid,
(b) a hydratable inorganic salt, and
(c) an organic polymer granulation aid soluble in alkaline aqueous medium, wherein the granulate, when dissolved in water, has a mildly acidic pH.

24 Claims, No Drawings

GRANULAR BLEACH AGENT: SOLID ALIPHATIC PEROXY-CARBOXYLIC ACID, INORGANIC SALT HYDRATE AND ORGANIC POLYMER

BACKGROUND OF THE INVENTION

1. Field of the Invention

This invention relates to bleaching agents in granulated form containing a solid aliphatic peroxycarboxylic acid as the bleaching component.

2. Description of Related Art

Bleaches based on peroxygen compounds are widely used in the bleaching of fabrics. Commonly used bleaches of this type include, in particular, hydrogen peroxide and its inorganic derivatives, such as sodium perborate and sodium percarbonate, which on the one hand represent mild oxidizing agents that are very safe to handle and, on the other hand, show good bleaching power at sufficiently high temperatures. By contrast, bleaching at relatively low temperatures requires stronger oxidizing agents, such as peroxycarboxylic acids for example, in order to obtain bleaching in a sufficiently short time. However, peroxycarboxylic acids (also referred to in short as percarboxylic acids or simply per-acids) are very aggressive oxidizing agents which show a tendency towards exothermic decomposition and explosion and cannot be handled in pure form without precautionary measures. Accordingly, it has been proposed inter alia—with a view to overcoming these disadvantages—to produce these compounds in situ from the non-dangerous inorganic per compounds and certain acylating agents, so called activators, which as such do not undergo exothermic decomposition or oxidation reactions, although they are sensitive to hydrolysis. This process is complicated by the use of two components which have to be separately metered, in addition to which the activation reaction between the inorganic per compounds and the activators requires an undesirably long induction time in some cases, above all at very low working temperatures.

For these reasons, attempts have long been made to find suitable measures to enable percarboxylic acids to be used as such for bleaching fabrics, despite their instability and aggressive chemical properties. In this connection, attention has been focused on the solid percarboxylic acids, particularly for use in combination with washing processes.

Thus, Belgian Patent 560 389 describes the stabilization of solid peroxycarboxylic acids using hydratable inorganic salts, in which the product may also be granulated. Conversion into the granulated form is particularly desirable when the percarboxylic acids are to be mixed with other components which, for example because of their sensitivity to oxidation, must not come into direct contact with the per-acids. DE-OS 2422 691 (British 1456591) mentioned one particular form of stabilization with salts in which mixtures of magnesium sulfate with a little sodium or potassium sulfate are used.

Another measure for preventing undesirable interactions between peroxycarboxylic acids and other components is the coating of per-acid particles. In FR-PS 1 262 475 (Canadian Patent 615,777), hydrophilic film forming agents, such as gelatin, are used for this purpose. According to GB-PS 1 387 167, water-impermeable materials, such as fats and waxes, are used for coating. Another variant is described in DE-OS 27 37 864 (U.S. Pat. No. 4,126,573) in which surfactants are used as coating materials.

In addition, numerous proposals have been made to combine desensitization by salt hydrates with the coating process, as for example in DE-OS 24 22 735 (British 1456592) which describes a mixture of two granulates of which one consists of percarboxylic acid particles containing salt hydrates and coated with fatty alcohol. Similar granulates are described in U.S. Pat. Nos. 3,770,816 and 4,170,453 and in DE-OS 26 52 424 (U.S. Pat. Nos. 4,225,451 and 4,288,388). U.S. Pat. No. 4,259,201 provides an example of the use of salt-containing, surfactant-coated per-acid granulates in detergents.

Although numerous problems involved in the use of peroxycarboxylic acids have been solved by the described measures, a percarboxylic acid formulation which satisfies all requirements in regard to safe handling, mechanical and chemical stability, solubility and economic production is still a long way off. Thus, although the granulates of per-acids and inorganic salts are sufficiently desensitized, they lack abrasion resistance so that, in many cases, it is not possible to prevent release of the peroxycarboxylic acids from the granulates during storage and, hence, oxidation of other sensitive components of the bleach preparations containing these granulates. Although the use of coating materials improves the mechanical properties, it does give rise to disadvantages, such as poor chemical stability in the case of certain hydrophilic coating materials or the prevention of dissolution in water in the case of hydrophobic coatings or those of anhydrous surfactants.

Accordingly, efforts are still being made to find new per-acid formulations having better all-round properties. In this connection, attempts are being made inter alia to fathom the dependence of stability on the type of auxiliaries added. Thus, many complexing agents capable of masking heavy metals have proved effective stabilizers against catalytic decomposition in almost all peroxycarboxylic acids, whereas with certain peroxycarboxylic acids, for example, surfactants promote decomposition, as mentioned in U.S. Pat. No. 3,639,285. With other peroxycarboxylic acids, certain coating compositions have a destabilizing effect, as can be seen from EP-OS 74 730 (Canada 190441). On the strength of these and other similar results, current opinion would appear to be that experience with one type of per-acid can rarely be applied to another type. Accordingly, optimal formulations can only be achieved by measures that are individually tailored to the particular type of percarboxylic acid.

SUMMARY OF THE INVENTION

The object of the present invention in this connection is to provide an improved formulation for solid aliphatic peroxycarboxylic acids in relation to the prior art.

According to the invention, this object is achieved by forming or building up a bleaching agent in the form of a granulate of uniform composition which contains solid aliphatic peroxycarboxylic acid and hydratable inorganic salt and which is characterized in that it contains an organic polymer compound soluble in alkaline-aqueous medium as granulating aid, wherein all the components are uniformly distributed in the individual granules of the granulate and which granulate alone, in water, gives a pH-value in the mildly acidic range. The term "granulate" as used herein is intended to mean the granulated form of the composition containing a plurality of individual particles or granules.

This peroxycarboxylic acid formulation represents a sufficiently desensitized, abrasion resistant, dust free and, hence, easy to handle form of the solid aliphatic per-acids. Despite their mechanical stability, the granulates dissolve rapidly in water or alkaline-aqueous medium, so that the per-acids present are immediately available as bleaches in the solution. In this form, the per-acids show unusual chemical stability and, accordingly, may be stored for long periods, even under adverse conditions. In addition, the granulates may readily be produced by build-up granulation in a one-step process.

In general, the per-acid granulates according to the invention may be used in any application where the percarboxylic acids present may be used with advantage as oxidizing, bleaching or disinfecting agents. However, they are preferably used in the bleaching of fibers and fabrics and, more particularly, in the bleaching of fabrics during washing. One particular advantage of the granulates in this respect is their compatibility with other detergent ingredients, particularly alkaline reacting substances and oxidation sensitive components, which enables the per-acids to be mixed with the detergents without further measures and to be stored in this form.

DETAILED DESCRIPTION AND PREFERRED EMBODIMENTS

The peroxycarboxylic acids present in the bleaching agents according to the invention are solid aliphatic compounds containing from 4 to 36 carbon atoms which contain the group $—CO_3H$ attached to carbon once or repeatedly in the molecule. They may optionally contain the groups $—CO_2H$, $—CO_2Me$, $—SO_3H$ and $—SO_3Me$ as substituents or ether oxygen, where Me is an equivalent of a metal cation from the group comprising $Na^+$, $K^+$, $Mg^{2+}$ and $Ca^{2+}$. Preferably the per-acids are unsubstituted compounds corresponding to the formula $C_{(n-x)}H_{(2n+2-3x)}(CO_3H)_x$ where $n=4$ to 36 and $x=1$ to 3. Particular preference is attributed to monoperoxycarboxylic acids containing from 10 to 18 carbon atoms and to diperoxycarboxylic acids containing from 6 to 22 carbon atoms, of which the unbranched $\alpha,\omega$-diperoxycarboxylic acids containing from 9 to 13 carbon atoms are particularly important by virtue of their particularly good bleaching effect. It is possible to use chemically uniform peracids as well as mixtures of two or more peracids. The peroxycarboxylic acids as pure compounds should be solid at room temperature and more especially at temperatures of up to 50° C. Particularly preferred per-acids are those which are solid at temperatures of up to 50° C. even in technical quality, i.e. with a distinct content of the parent carboxylic acid. The per-acid content of the granulates is from 3 to 50% by weight, preferably from 5 to 30% by weight and more preferably from 7 to 20% by weight.

Suitable hydratable inorganic salts for the granulates according to the invention are salts of sodium, potassium, magnesium, calcium and aluminum with oxidation stable anions of mineral acids, providing these salts are capable of forming defined hydrates and do not show an alkaline reaction in water. Examples of salts such as these are $NaH_2PO_4$ and $KAl(SO_2)_2$. Sodium sulfate and magnesium sulfate are preferably used, a mixture of sodium sulfate and magnesium sulfate in a ratio of from 2:1 to 40:1 and preferably in a ratio of from 5:1 to 25:1 (based on the anhydrous forms) being particularly preferred. The inorganic salt content of the granulates is from 40 to 95% by weight, preferably from 70 to 92% by weight and more preferably from 75 to 90% by weight, again calculated as, based on, the anhydrous form of the salt.

Particular importance is attributed to the granulation aid. Suitable granulation aids are organic polymer compounds soluble in alkaline-aqueous medium, such as soluble cellulose or starch derivatives or soluble, fully synthetic polymers. Examples are methyl cellulose, solid polyethylene oxides, polyvinyl pyrrolidone and polymeric carboxylic acids. It is preferred to use homopolymers of acrylic acid, maleic acid and crotonic acid and copolymers thereof with one another and with other monomers, particularly polyacrylic acid, maleic acid-acrylic acid copolymers (molar ratio 1:5 to 5:1) and crotonic acid-vinyl acetate copolymers (1:10 to 1:80), which give per-acid granulates of particularly high quality. Polymers containing carboxyl groups are preferably present in the acid form, although they may even be partially used as salts, providing those salts do not show an alkaline reaction. The polymeric granulation aid is preferably used in a quantity of from 0.2 to 10% by weight and more preferably in a quantity of from 0.5 to 4% by weight, based on the bleaching agent as a whole.

By using the above-mentioned granulation aids, it is possible to convert the mixtures of per-acids and salts into mechanically stable granulates using small quantities of these additives without the granules having to be coated. This simplifies the production of stable per-acid granulates and, at the same time, avoids the disadvantages of coated products, above all the slow disintegration of the granules in the bleaching solution. In addition, the uniform distribution of all the components in the individual granules and the presence of the granulation aids would appear even to promote the dispersion and dissolution of the per-acid particles present in the granulates in the solution. The use of granulation aids dissolving only in alkaline medium, for example crotonic acid/vinyl acetate copolymers, is particularly advantageous here.

In the quantities used, the granulation aids surprisingly do not affect the chemical stability of the per-acids, so that the products largely retain their bleaching activity, even in the event of prolonged storage. However, the stability of the products may often be further increased by various additives. Thus, it has been found that chelate complexing agents for heavy metals, particularly in quantities of up to 2% by weight and preferably in quantities of from 0.1 to 1% by weight, can have a beneficial effect on retention of the active oxygen during storage and/or during the bleaching process in solution. Any of the complexing agents normally used for stabilizing peroxycarboxylic acids are suitable, although it is preferred to use polyphosphonic acids, such as 1-hydroxyethane-1,1-diphosphonic acid, or ethylene diamine tetramethylene phosphonic acid and salts thereof.

In addition, it has surprisingly been found that certain surfactants do not adversely affect the stability of the granulates in storage, even when they are uniformly incorporated in the granules. The surfactants in question are certain anionic surfactants, namely the salts of long-chain ($C_6$–$C_{22}$) monoalkyl sulfuric acid esters (alcohol sulfates), more especially fatty ($C_8$–$C_{18}$) alcohol sulfates and the salts of sulfuric acid semi-esters of the reaction products of long-chain alcohols, particularly fatty alcohols, with ethylene oxide, hereinafter EO, (ether sulfates). On the contrary, these surfactants appear in some cases further to improve stability in storage and to have a positive effect upon the bleaching results obtainable with the granulates. These surfactants may be present in the granulates in quantities of up to 10% by weight and preferably in quantities of from 1 to 5% by weight.

The ready-formulated bleaching agents mayt contain water as a further optional constituent in quantities of up to 20% by weight and preferably in quantities of from 0.5 to 5% by weight. The quantity of water present is always smaller than the quantity which may be calculated as the maximum possible proportion of water of hydration from the salt content of the granulates. The water content of the granulates emanates from their production. The presence of water has a beneficial effect on the desensitization of the per-acids, although it mot absolutely essential for that purpose.

In addition to the components mentioned above, other components may be incorporated in the granulates providing they do not adversely affect the positive properties of the basic composition. Components such as these are, for example, additional desensitizing agents, flow or solubility modifiers and buffers. At all events, it is important to ensure that no alkaline-reacting materials are used and that the granulates show a mildly acidic reaction. They should have a pH value of from 3 to 7 and preferably of from 4 to 6 in water (0.5%). Keeping to these limits is crucial to the chemical stability of the granulates.

The granulates are best produced by methods in which thermal and mechanical stressing, which could lead to decomposition of the per-acids, is avoided particularly suitable granulation processes are those of the build-up or agglomeration type, in which small particles are built up or agglomerated into the desired particle size. Illustrative are processes such as fluidized-bed granulation, rolling granulation in rotating drums or on granulation pans, and mixed granulation, of which the mixed granulation processes, especially in mixers comprising rotating tools, such as for example Patterson-Kelly mixers, Lodige mixers and Forberg mixers, are particularly preferred.

Production by the methods mentioned above ensures that, where their particle size permits, all the constituents are uniformly distributed in the individual granules and all the granules have the same composition.

In general, the production process itself does not start out from the pure percarboxylic acids, but instead from safe to handle premixes of the type which accumulate inter alia in the production of the percarboxylic acids, for example in accordance with DE-OS 2930 546 (U.S. Pat. No. 4,287,135). Premixes such as these contain (based on dry matter) from about 10 to 90% by weight of the solid aliphatic peroxycarboxylic acid and, in addition, traces of the parent carboxylic acid (due to inadequate reaction during conversion into the per-acid), traces of hydrogen peroxide, and inorganic salts, particularly $Na_2SO_4$ and $MgSO_4$. A particular advantage is that, to produce the granulates according to the invention, these per-acid premixes do not have to be dried, but instead may be used in the moist form in which they initially accumulate during production. The water content of the premixes may even exceed the maximal quantity fixable as water of hydration in the salts.

In the case of mixed granulation, the solid per-acid or, preferably, the per-acid premix is introduced into the granulator, for example a Patterson-Kelly V mixer or a Lodige ploughshare mixer, with other solid constituents of the granulates and intensively premixed therewith. Water or a solution or suspension of granulate constituents in water, preferably an aqueous solution of the granulation aid, is then introduced with continuous movement of the apparatus, after which the continuous movement of the apparatus is continued until all the constituents have been uniformly distributed and the desired grain spectrum of the granulates has been formed. The quantity of water is preferably selected so that the moist granulate initially formed has a water content of from 8 to 30% by weight. If the starting materials already contain enough water, there is no need for water to be added during the granulation process. The described mixed granulation may be carried out at room temperature and even at slightly elevated temperatures of up to about 45° C. and preferably at a temperature of from 32° to 40° C. If desired, granulation may be followed by drying of the granulates, optionally in the same apparatus or even by other careful methods, for example, of the fluidized-bed type. Dried granulates are preferred above all in cases where the per-acid formulation is required to be substantially free from ballast. If the granulates are obtained by a method which gives a very broad grain size distribution, it may be advisable to sieve the end product and to recycle unwanted grain sizes, optionally after grinding.

The resulting per-acid granulates are distinguished by high mechanical stability and, in particular, by abrasion resistance. They may be produced in various grain sizes, above all in the 0.1 to 5 mm range. The 0.4 to 1.6 mm range is of particular importance for incorporation in detergents, whereas coarser granulates with grain sizes in the 1.6 to 4 mm range may even be preferred for independently used special products. The granulates according to the invention generally have powder densities of from 400 to 1200 grams per liter and preferably from 500 to 1000 g/l.

It is of course readily possible subsequently to apply inert coatings of various kinds, whether in the form of continuous films or in the form of fine powders applied by deposition, to the granulates according to the invention, although it is precisely the advantage of the invention that such a measure is not essential.

The particularly preferred field of application for the bleaching agents according to the invention is in the bleaching of fabrics in conjunction with a washing treatment. For this purpose, the granulates may be used as such, i.e. without further additive, although they are preferably made up as scattering mixtures with other solid active substances required for the treatment of fabrics. Thus, a bleach based on the granulates according to the invention may contain, for example, alkalizing agents, per-acid activators and, optionally, other bleaching agents, such as perborate for example, as further active substances. In addition, surfactants, builders, foam inhibitors and optical brighteners are mentioned as active substances for a combined washing and bleaching preparation. In these made-up forms, the outstanding mechanical and chemical stability of the granulates and their compatibility with the surrounding materials are particularly advantageous, particularly in regard to the stability of the end products in storage.

EXAMPLES

Example 1

Granulate containing diperoxydodecane-1,12-diacid 2.03 kg of a moist filter cake (composition in % by weight: diperoxydodecane diacid 29.6; sodium sulfate 54.8; dodecane diacid 2.6; water 13), 3.95 kg anhydrous sodium sulfate and 0.34 kg magnesium sulfate (water content 30% by weight) were introduced into a 15 liter Patterson-Kelly V mixer and premixed for 1 minute at 20 r.p.m. Thereafter, 0.66 kg of a dispersion of a crotonic acid -vinyl acetate copolymer (molar ratio 1:17.6; 16% by weight in water)are sprayed into the rotating mixer through the spray shaft (1860 r.p.m.) for a period of 3 minutes. After another 30 seconds mixing, a moist granulate had formed and was discharged and then dried for 15 minutes in a fluidized-bed dryer in which the air flowing in at approximately 15 $m^3$/minute had a temperature of 40° to 44° C. A granulate having a residual water content of 0.8% by weight (as determined by vacuum drying for 24 hours at 30 mbar/45° C.) was obtained. Sieve analysis showed 75% by weight of the granules between 0.4 and 1.6 mm in size; powder density 870 g/l; pH 4.6 (0.5% suspension in water). The grains smaller than 0.4 mm (10% by weight) and larger than 1.6 mm (15% by weight) were not recycled in this test. Further analytical data are shown in Table 1.

Example 2

Granulate containing diperoxydodecane-1,12-diacid 0.69 kg of a desensitized dry diperdodecane diacid (composition in % by weight: per-acid 34; $Na_2SO_4$63; dodecane diacid 3), 1.08 kg dry $Na_2SO_4$, 0.23 kg $MgSO_4$. $H_2O$ (water content 30% by weight) and 33 g powdered polyacrylic acid (molecular weight approx. 1000) were introduced into the same mixer as in Example 1 and premixed for 2 minutes at 20 r.p.m. 0.325 kg of water was then sprayed in through the spray shaft for 1 minute. The moist granulate formed was dried for 30 minutes in a fluidized bed dryer (air flow approx. 2 $m^3$/minute, 40° C.). For analytical data, see Table 1.

Example 3

Granulate containing diperoxybrassylic acid 1.685 kg of a dry desensitized diperoxybrassylic acid (composition in % by weight:per-acid 26.7; $Na_2SO_4$ 70.8; brassylic acid 2.5), 2.56 kg anhydrous $Na_2SO_4$ and 0.26 kg $MgSO_4$. $H_2O$ (water content 30%) were mixed for 3 minutes at approx. 20 r.p.m. in the same mixer as in Example 1. 0.42 kg of a solution of polyacrylic acid (19% by weight in $H_2O$ was than sprayed in through the spray shaft for a period of 0.5 minute. After mixing for 1.5 minutes, a moist granulate was obtained and was then dried for 20 minutes in a fluidized bed dryer (7 $m^3$/min air at 40° C.) to a water content of 1% by weight. According to sieve analysis, 86.5% by weight of the granulate was between 0.4 and 1.6 mm in size, 3.5% by weight was smaller than 0.4 mm and 10% by weight larger than 1.6 mm. The main fraction had a powder density of 810 g/l. For further data, see Table I.

Examples 4 to 7

Further examples of granulates containing diperoxydodecane-1,12-diacid

In mixed granulators equivalent to those of Examples 1 and 2, various moist granulates were prepared from moist per-acid/$Na_2SO_4$ mix, granulation aids and, optionally, surfactants and phosphonic acid and subsequently dried in a fluidized bed dryer. Their compositions are shown in Table 1.

TABLE 1

COMPOSITION OF THE PER-ACID GRANULATES (IN % BY WEIGHT)

| Example | 1 | 2 | 3 | 4 | 5 | 6 | 7 |
|---|---|---|---|---|---|---|---|
| Per-acid (iodometric) | 9.8 | 11.6 | 9.9 | 10.0 | 10.0 | 10.0 | 10.0 |
| Starting Carboxylic Acid | 0.9 | 1.1 | 0.9 | 0.9 | 0.9 | 0.9 | 0.9 |
| Sodium Sulfate | 82.9 | 74.6 | 82.4 | 81.0 | 80.7 | 80.8 | 78.8 |
| Magnesium Sulfate | 3.9 | 7.9 | 4.0 | 4.0 | 4.0 | 4.0 | 4.0 |
| Polyacrylic Acid | | 1.6 | 1.8 | | | | 1.6 |
| Vinylacetate-Crotonic Acid Copolymer (Molar ratio 17.6:1) | 1.7 | | | 1.6 | 1.6 | 1.6 | |
| Water | 0.8 | 3.2 | 1.0 | 0.5 | 0.8 | 0.7 | 0.7 |
| Tallow Alcohol Sulfate | | | | 2.0 | | | 2.0 |
| Cocosalkyl-4-EO-Sulfate | | | | | 2.0 | | |
| 1-Hydroxyethane-1,1-Diphosphonic Acid | | | | | | 0.5 | 2.0 |
| 0.4–1.6 mm Fraction | 75.0 | 72.6 | 86.5 | 95.3 | 95.2 | 71.5 | 95.6 |
| Powder density (g/l) of the 0.4–1.6 mm Fraction | 870 | 730 | 810 | 840 | 940 | 810 | 905 |

Example 8

Determination of stability in storage

Quantities of 400 g of the granulates were weighed into unlined detergent packets (size E2) and were stored therein in a conditioned room at 30° C./80% relative air humidity. The active oxygen content was iodimetrically determined at the beginning and after storage for 4, 8, 12 and 16 weeks. The results of these tests, which are set out in Table 2, show the excellent stability of the granulates in storage.

TABLE 2

STABILITY IN STORAGE (Degree of retention of the active oxygen in percent of the original content)

| Example | 4 | 8 | 12 | 16 |
|---|---|---|---|---|
| 1 | 88.3 | 85.2 | 85.2 | 80.0 |
| 2 | 94.4 | 84.8 | 82.4 | 77.6 |
| 3 | 90.4 | 89.4 | 89.4 | 86.5 |
| 4 | 95.7 | 91.3 | — | — |
| 5 | 92.4 | 85.9 | 79.8 | 73.7 |
| 6 | 89.3 | 84.1 | 81.3 | 76.6 |
| 7 | 91.1 | 86.2 | 84.8 | 82.1 |

Example 9

Determination of bleaching activity

The bleaching tests were carried out in domestic tumbler type washing machines at a maximum solution temperature of 30° C. and over a washing time of 15 minutes so that any differences in the dissolving behavior of the granulates were very clearly apparent. The washing solution (20 l per machine) contained 120 g of a detergent having the following compositions:

| | |
|---|---|
| Alkyl benzene sulfonate | 7% by weight |
| Fatty alcohol ethoxylates | 3.3% by weight |
| Soap ($C_{18}$–$C_{22}$) | 2% by weight |
| $Na_5P_3O_{10}$ | 31% by weight |
| Sodium aluminum silicate | 18% by weight |
| Sodium silicate | 3.2% by weight |
| Magnesium silicate | 1.3% by weight |
| $Na_2SO_4$, water | ad 100% by weight |

Together with the detergent, the particular per-acid granulate was dispensed in such a quantity that the solution contained 30 ppm active oxygen. Comparison tests were carried out with non-granulated diperoxydodecane-1,12-diacid present in powder form 34% in admixture with $Na_2SO_4$. The washing machine each contained 3.5 kg white ballast fabric and two test strips each of several made-up soils which were washed together, rinsed 5 times with 25 l of water and tumble dried. To determine the bleaching effect, the light remission of the test strips was measured at 460 nm using a Zeiss Elrepho photometer.

Comparison of the results set out in Table 3 for the various granulates, for non-granulated per-acid and for the bleach-free washing shows that the granulates release the per-acid extremely quickly, even under the mild conditions selected. The deterioration in the bleaching effect compared with the non-granulated per-acid is of no significance in practice.

TABLE 3

BLEACHING RESULTS (IN % LIGHT REMISSION)

| Bleach Additive Example | Stain: Red Wine on Finished Cotton | Tea on Finished Cotton | Coffee on Cotton |
|---|---|---|---|
| None | 44.4 | 39.9 | 61.6 |
| Non-Granulated | 56.1 | 59.2 | 69.8 |
| 1 | 55.8 | 57.2 | 68.1 |
| 2 | 55.4 | 55.1 | 66.1 |
| 3 | 55.6 | 56.9 | 66.1 |
| 4 | 56.3 | 58.1 | 68.4 |
| 5 | 55.9 | 59.2 | 64.9 |
| 6 | 56.1 | 59.0 | 69.1 |
| 7 | 56.3 | 59.4 | 69.0 |

We claim:

1. A bleaching agent in the form of a granulate of uniform composition comprising:
   (a) from about 3 to about 50% by weight of at least one solid aliphatic peroxycarboxylic acid,
   (b) from about 40 to about 95% by weight of at least one hydratable inorganic salt, and
   (c) from about 0.2 to about 10% by weight of an organic polymer granulation aid soluble in an alkaline aqueous medium, wherein the organic polymer is selected from the group consisting of polyacrylic acid, maleic acid-acrylic acid copolymer wherein the molar ratio is 1:5 to 5:1, and crotonic acid-vinyl acetate copolymer wherein the molar ratio is 1:10 to 1:80, and wherein all of said components (a), (b) and (c) are uniformly distributed in the individual granules of said granulate and in that in water alone said granulate has a pH in the mildly acidic range.

2. A bleaching agent as defined in claim 1 wherein said pH is in the range of 3 up to 7.

3. A bleaching agent as defined in claim 1 wherein said hydratable inorganic salt is a salt of a cation selected from the group consisting of sodium, potassium, magnesium, calcium, aluminum and mixtures thereof and an oxidation stable anion of a mineral acid.

4. A bleaching agent as defined in claim 3 wherein said hydratable inorganic salt is a mixture of sodium and magnesium sulfate in a weight ratio calculated as anhydrous form is in a ratio from about 2:1 to 40:1.

5. A bleaching agent as defined in claim 1 wherein said peroxycarboxylic acid is an aliphatic compound containing 4–36 carbon atoms and containing at least one —$CO_3H$ group.

6. A bleaching agent as defined in claim 5 wherein said peroxycarboxylic acid is diperoxydodecanedioic acid.

7. A bleaching agent as defined in claim 5 wherein said peroxycarboxylic acid is diperoxybrassylic acid.

8. A bleaching agent as defined in claim 5 wherein said peroxycarboxylic acid is from 3–50% by weight of said granulate.

9. A bleaching agent as defined in claim 1 wherein said granulation aid is employed in an amount of from 0.2 to about 10% by weight based on the weight of bleaching agent.

10. A bleaching agent as defined in claim 1 wherein said granulation aid is polyacrylic acid.

11. A bleaching agent as defined in claim 1 wherein said granulation aid is a copolymer of maleic acid and acrylic acid and the molar ratio of maleic acid to acrylic acid in said copolymer is 1:5 to 5:1.

12. A bleaching agent as defined in claim 1, wherein said granulation aid is a copolymer of crotonic acid and vinyl acetate and the molar ratio of crotonic acid to vinyl acetate in said copolymer is 1:10 to 1:80.

13. A bleaching agent as defined in claim 1 and further comprising a polyphosphonic acid chelate complexing agent.

14. A bleaching agent as defined in claim 1 further comprising a surfactant selected from the group consisting of an ether sulfate and alcohol sulfate.

15. A bleaching agent as defined in claim 1 containing from:
   (a) 3 to 50% by weight of a peroxycarboxylic acid selected from the group consisting of a $C_{10}$–$C_{18}$ monoperoxycarboxylic acid and a $C_6$–$C_{22}$ diperoxycarboxylic acid,
   (b) from 40 to 95% by weight of said hydratable inorganic salt,
   (c) from 0.2 to 10% by weight of said granulation aid, and
   (d) up to 2% by weight of a chelate complexing agent for heavy metals,
   (e) up to 10% by weight of alcohol sulfate or ether sulfate and
   (f) up to 20% by weight of water.

16. A bleaching agent as defined in claim 1 containing:
   (a) from 5 to 30% by weight of a $C_9$–$C_{13}$ $\alpha,\omega$-diperoxycarboxylic acid, (b) from 70 to 92% by weight of an inorganic salt mixture of $Na_2SO_4$ and $MgSO_4$ in a ratio of from 2:1 to 40:1, (c) from 0.5 to 4% by weight of a granulation aid selected from the group comprising polyacrylic acid, a maleic acid - acrylic acid copolymer wherein the molar ratio of maleic acid to acrylic acid is 1:5 to 5:1 and a crotonic acid vinyl acetate copolymer wherein the molar ratio of crotonic acid to vinyl acetate is 1:10 to 1:80, (d) from 0.1 to 1% by weight of polyphosphonic acid, (e) from 1 to 5% by weight of a surfactant selected from the group consisting of a fatty alcohol sulfate and a fatty alcohol ether sulfate and (f) from 0.5 to 5% by weight of water.

17. A process for producing a bleaching agent in granular or granulate as defined in claim 1 comprising mixing said peroxycarboxylic acid, said hydratable inorganic salt and said granulation aid components so as to form granules wherein each of said components is uniformly distributed in the individual granules and each granule has substantially the same composition.

18. A process as defined in claim 18 wherein said solid peroxycarboxylic acid is premixed with said hydratable inorganic salt after which said premixture is contacted with an aqueous solution of said granulation aid polymer under continuous agitation or movement of said acid, salt and said polymer for a sufficient time for granules to build to a grain size in the range of 0.1 to 5 mm to provide a granulate having a powder density of 400–1200 grams per liter.

19. A process of oxidizing, bleaching and disinfecting comprising contacting a material to be oxidized, bleached or disinfected with an aqueous solution of the bleaching agent defined in claim 1.

20. A process as defined in claim 19 wherein said material is a fiber or fabric.

21. A process as defined in claim 20 wherein said material is also contacted with a detergent.

22. A bleaching composition in the form of granules comprising (a) about 3 to about 50% by weight of a C4-20 alkyl-diperoxycarboxylic acid and (b) about 4 to about 95% by weight of a mixture of hydrated sodium sulfate and magnesium sulfate wherein the mole ratio of sodium sulfate to magnesium sulfate is greater than about 1:1 and wherein the weight ratio of said magnesium sulfate to said diperoxycarboxylic acid is less than 1:1 and wherein the total water content in said granules is controlled between about 50 to 70% by weight of said magnesium sulfate and (c) from about 0.2 to about 10% by weight of polyacrylic acid or a copolymer of acrylic acid.

23. A method of forming a stable, granular peracid composition comprising combining a C4-20 alkyl-diperoxycaroboxylic acid, sodium sulfate, magnesium sulfate, and a polymer consisting of polyacrylic acid or a copolymer of acrylic acid, and forming discrete granules therefrom, said granules being characterized in that the weight ratio of magnesium sulfate to C4-20 alkyl-diperoxycarboxylic acid is less than 1:1 and the mole ratio of sodium sulfate to magnesium sulfate is greater than or equal to about 1:1.

24. A method to produce a stable granular peracid composition comprising:

combining a C4-20 alkyl-diperoxycarboxylic acid with sodium sulfate and magnesium sulfate;

forming discrete granules therefrom;

controlling the water content of said granules such that the water content is in the range of about 50 to about 70% by weight of solid magnesium sulfate;

restricting the weight ratio of magnesium sulfate to C4-20 alkyl-diperoxycarboxylic acid to less than 1:1 and restricting the mole ratio of sodium sulfate to magnesium sulfate to greater than or equal to about 1:1.

* * * * *

UNITED STATES PATENT AND TRADEMARK OFFICE

CERTIFICATE OF CORRECTION

PATENT NO. : 5,091,106

DATED : February 25, 1992

INVENTOR(S) : Jacobs et al.

It is certified that error appears in the above-identified patent and that said Letters Patent is hereby corrected as shown below:

In claim 18, column 11, line 23,"claim 18" should read --claim 17--.

Signed and Sealed this

Twenty-eighth Day of September, 1993

*Attest:*

*Attesting Officer*

BRUCE LEHMAN

*Commissioner of Patents and Trademarks*